US006923328B2

(12) United States Patent
Birken

(10) Patent No.: US 6,923,328 B2
(45) Date of Patent: Aug. 2, 2005

(54) METHOD AND APPARATUS FOR SEPARATING METAL VALUES

(75) Inventor: Stephen M. Birken, Rexford, NY (US)

(73) Assignee: Wave Separation Technologies LLC, Albany, NY (US)

( * ) Notice: Subject to any disclaimer, the term of this patent is extended or adjusted under 35 U.S.C. 154(b) by 134 days.

(21) Appl. No.: 10/080,773

(22) Filed: Feb. 22, 2002

(65) Prior Publication Data

US 2004/0258591 A1 Dec. 23, 2004

(51) Int. Cl.[7] ..... B03B 1/00; B03C 1/00

(52) U.S. Cl. ..... 209/3; 209/4; 209/11; 209/214; 423/25; 423/151; 423/152

(58) Field of Search ..... 423/151, 152, 423/25; 209/3, 4, 8, 11, 214

(56) References Cited

U.S. PATENT DOCUMENTS

| | | | |
|---|---|---|---|
| 3,463,310 | A | 8/1969 | Ergun et al. |
| 4,311,520 | A | 1/1982 | Kruesi et al. |
| 4,321,089 | A | 3/1982 | Kruesi et al. |
| 4,324,582 | A | 4/1982 | Kruesi et al. |
| 4,678,478 | A | 7/1987 | Kelland |
| 4,894,134 | A | 1/1990 | Birken et al. |
| 5,024,740 | A | 6/1991 | Birken et al. |
| 5,393,320 | A | 2/1995 | Gomez |
| 5,521,360 | A | 5/1996 | Johnson et al. |
| 5,784,682 | A | 7/1998 | Birken et al. |
| 5,997,607 | A | 12/1999 | Birken et al. |
| 6,090,350 | A | 7/2000 | Birken et al. |
| 6,277,168 | B1 | 8/2001 | Huang et al. |

OTHER PUBLICATIONS

Grant & Hackh's Chemical Dictionary, 5$^{th}$ edition, 1987, no month, p. 371.*

* cited by examiner

*Primary Examiner*—Steven Bos
(74) *Attorney, Agent, or Firm*—Honigman Miller Schwartz and Cohn LLP

(57) ABSTRACT

Methods and apparatuses for separating metal values, such as nickel and nickel compounds, from mineral ores, including lateritic ores are disclosed. The method includes providing a mixture of particles (e.g., crushed and sized ore) that is composed of at least a first group of particles and a second group of particles. Group members have similar chemical composition, while particles belonging to different groups have dissimilar chemical compositions. The mixture of particles is exposed to microwave/millimeter wave energy in order to differentially heat the first and second group of particles, thereby increasing differences in magnetic susceptibility between the first and second group of particles. The mixture of particles is then passed through a magnetic field gradient, which causes the particles to separate into magnetic and non-magnetic fractions.

17 Claims, 2 Drawing Sheets

METHOD AND APPARATUS FOR SEPARATING METAL VALUES

BACKGROUND OF THE INVENTION

1. Field of the Invention

The present invention relates to mineral processing, and more particularly, to a method and apparatus for separating metal values, such as nickel and nickel compounds, from mineral ores, including lateritic ores.

2. Discussion

Nickel is an important element and is used in a variety of products. It is often combined with other metals to form stainless steels and alloy steels, nonferrous and high temperature alloys. It is also used in electroplating, catalysts, ceramics and magnets.

Though nickel can be found in many different types of mineral deposits, currently only sulfide and lateritic ores can be mined economically using existing technology. In sulfide ores, nickel, iron and copper comprise a physical mixture of distinct minerals. This allows producers to concentrate the nickel present in sulfide ores using mechanical techniques, such as flotation and magnetic separation. Lateritic ores have a significantly different structure than sulfide ores. As a result, nickel producers cannot use straightforward mechanical or physical separation techniques to concentrate the nickel in lateritic ores, but instead must use chemical separation techniques.

One of the most promising chemical methods for obtaining nickel values from lateritic ores is called high pressure acid leaching. In the method, crushed and sized lateritic ore is placed in a pressure vessel with sulfuric acid. The mixture is agitated at high temperature and high pressure (e.g., 280° C., 5.4 MPa) to leach out nickel and cobalt. The resulting liquid phase, which includes dissolved nickel and cobalt, undergoes further processing to separate nickel and cobalt.

Though a useful technology, high pressure acid leaching suffers certain disadvantages. As currently practiced, high pressure acid leaching is carried out in a batch-wise manner. Since nickel comprises only about one percent of a typical lateritic ore, the pressure vessel must be charged with large amounts of ore—e.g., one hundred tons of ore—to meet daily production requirements. This results in a large capital outlay for equipment. As compared to mechanical techniques, operating costs are high because the entire mixture must be heated to relatively high temperatures to extract a significant fraction of nickel and cobalt from the solid phase. Finally, disposal of spent sulfuric acid raises environmental concerns.

The present invention overcomes, or at least mitigates, one or more of the problems described above.

SUMMARY OF THE INVENTION

The present invention provides methods and apparatuses for separating metal values, such as nickel and nickel compounds, from mineral ores, including lateritic ores. The inventive methods use physical processes to concentrate metal values and therefore do not raise environmental concerns associated with chemical processing. In addition, the methods are adapted to continuously process ores, which results in lower capital outlays than batch operations. Finally, the disclosed invention utilizes microwave/millimeter wave technology to selectively heat components of the ore, which helps conserve energy resources.

One aspect of the invention thus provides a method of separating components of a mixture of particles, which is comprised of at least a first group of particles and a second group of particles. Group members have similar chemical composition, while particles belonging to different groups have dissimilar chemical compositions. The method also includes exposing the mixture of particles to microwave/millimeter wave energy in order to differentially heat the first and second group of particles, thereby increasing the difference in magnetic susceptibility between the first and second group of particles. Finally, the method comprises exposing the mixture of particles through a magnetic field gradient, which causes the particles to separate into first and second fractions. The first and second fractions have, respectively, greater percentages of the first and second groups of particles than the mixture.

A second aspect of the invention provides a method of concentrating nickel values of a lateritic ore. The method comprises providing a lateritic ore comprised of a mixture of particles, and exposing the lateritic ore to microwave/millimeter wave energy in order to selectively heat particles that contain substantial amounts of nickel values. The exposure to microwave/millimeter wave energy increases the difference in magnetic susceptibility between the particles that contain substantial amounts of nickel values and particles that do not. In addition, the method includes exposing the lateritic ore through a magnetic field gradient, which causes at least some of the particles that contain substantial amounts of nickel values to separate from the mixture of particles.

A third aspect of the invention provides an apparatus for separating components of a mixture of particles. The apparatus includes a vessel having an interior for containing the mixture of particles during processing, and an energy system coupled to the vessel for exposing the mixture of particles to microwave/millimeter wave energy. The apparatus also includes a magnetic separator that communicates with the interior of the vessel. The magnetic separator is adapted to separate magnetic particles from non-magnetic particles.

A fourth aspect of the invention provides an apparatus for continuously separating components of a mixture of particles. The apparatus includes a vessel for containing the mixture of particles during processing. The vessel has a first end and a second end and an inlet located adjacent to the first end of the vessel that permits entry of the solid particles into the vessel. The apparatus also includes a gas distributor that is disposed within the vessel for fluidizing the mixture of particles, and an energy system that is coupled to the vessel for exposing the mixture of particles to microwave/millimeter wave energy. Finally, the apparatus also includes a magnetic separator, which is located adjacent the second end of the vessel and which is used to separate magnetic particles from non-magnetic particles.

DETAILED DESCRIPTION

Figure 1:
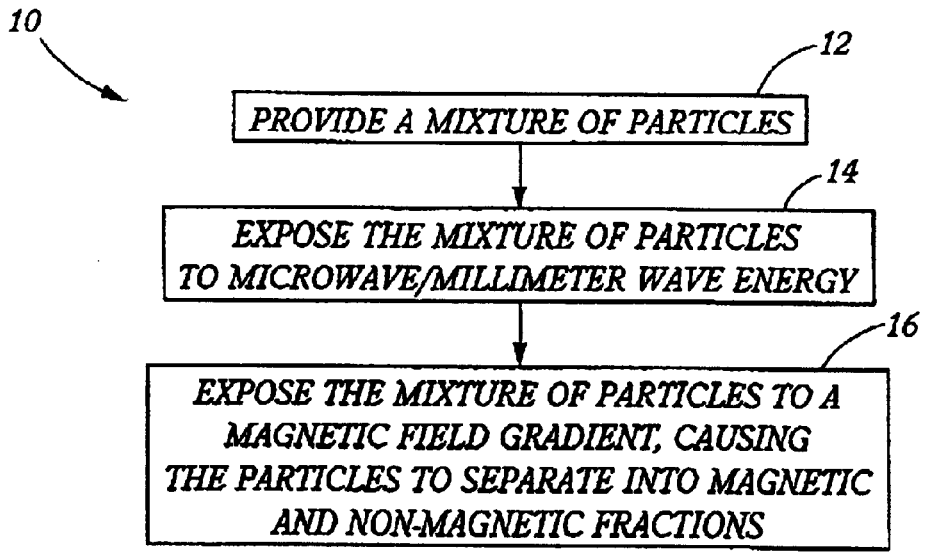
FIG. 1 is a block diagram showing a method of separating components of a mixture of particles.

FIG. 1 provides an overview of a method 10 of separating components of a mixture of particles. The method relies on heating groups of particles to different temperatures using microwave/millimeter wave energy, and then exploiting changes in magnetic susceptibility among the particles—resulting from the temperature differences—to effect a magnetic separation of the groups of particles. The method can be used to extract metal values from mineral ores that ordinarily are not amenable to physical separation techniques. For example, and as discussed below, the method can be used to concentrate nickel values from lateritic ores without the high temperatures, high pressures, and harsh acidic conditions associated with acid leaching. Unless clear from the context of the discussion, the terms "nickel," "cobalt," and "iron" or "nickel values," "cobalt values," and "iron values," etc. may refer, respectively, to nickel, cobalt and iron atoms or to compounds that contain nickel, cobalt and iron atoms.

As shown in FIG. 1, the method 10 includes providing 12 a mixture of particles in an enclosure, vessel or cavity. The mixture of particles is comprised of at least a first group of particles and a second group of particles. Individual particles that belong to a particular group—i.e., first group, second group, etc.—have similar chemical composition, whereas particles that belong to different groups have dissimilar chemical compositions. Thus, for example, crushed and sized lateritic ore may comprise a first group of particles that contain predominantly nickel oxide, a second group of particles that contain predominantly cobalt oxide, a third group of particles that contain iron oxide (FeO) and a fourth group of particles that contain comparatively valueless earth (gangue). Individual nickel oxide, cobalt oxide or iron oxide particles may include gangue, as well as minor portions of other metal oxides.

Besides providing a mixture of particles, the method 10 also includes exposing 14 the mixture to microwave/millimeter wave energy. Since dissimilar substances generally absorb microwave/millimeter wave radiation in differing amounts, exposing the mixture of particles to microwave/millimeter wave radiation, results in differential or selective heating of the groups of particles. Moreover, for many substances, including ferromagnetic and antiferromagnetic materials, magnetic susceptibility (i.e. the ratio of the induced magnetization to magnetic field intensity) depends on the temperature of the material. For instance, a ferromagnetic material will lose all magnetic properties above its Curie temperature and an antiferromagnetic material will exhibit maximum magnetic susceptibility at its Néel temperature. Nickel oxide, for example, should exhibit maximum magnetic susceptibility at its Néel temperature, which ranges from about 260° C. to about 377° C., and FeO should exhibit maximum magnetic susceptibility at its Néel temperature, which is about −75° C.

As noted above, the method 10 shown in FIG. 1 utilizes changes in magnetic susceptibility among the particles to separate the groups of particles. Thus, the method 10 includes exposing 16 the mixture of particles to a magnetic field gradient, which causes the particles to separate into first and second fractions. The first and second fractions are comprised primarily of the first and second groups of particles, respectively. Thus, for example, the first group of particles may comprise nickel oxide particles, which have been selectively heated to about their Néel temperature. The second group of particles may comprise gangue (e.g., silicon dioxide) and the like which have been heated to a lesser extent. When the mixture of particles are exposed to the magnetic field gradient, the nickel oxide particles tend to align themselves with the lines of force that comprise the magnetic field gradient, whereas the non-nickel particles remain relatively unaffected by the magnetic field gradient. Since the nickel oxide particles follow the lines of magnetic force, the method 10 diverts nickel oxide particles away from the primary flow direction of the mixture of particles.

Effective separation will depend on many factors, including the size distribution of the mixture of particles, differences in magnetic susceptibility among the groups of particles, the intensity of the applied magnetic field gradient, and so on. Depending on the type of magnetic separator used, the particle sizes of the base material (e.g., the mineral ore) usually range from about $10^{-1}$ microns to about $10^{4}$ microns. For high gradient magnetic separators, which can apply magnetic field gradients up to about $25\times10^{6}$ G/cm, the particle sizes of the base material typically fall within the lower portion of the particle size range—i.e., from about $10^{-1}$ microns to about $10^{2}$ microns. For other types of dry magnetic separators, which can apply magnetic field gradients between about $10^{2}$ G/cm and $10^{5}$ G/cm, the particles sizes of the base material ordinarily fall within the upper portion of the particle size range.

In many cases, only one of the groups of particles will exhibit measurable magnetic susceptibility following exposure to microwave/millimeter wave energy and that group will be the valuable component. In other cases, the valuable component may exhibit negligible magnetic susceptibility, while the remaining particles are magnetic. In instances when two or more groups of particles exhibit substantial magnetic susceptibility, and only one of the group of particles is of interest, microwave/millimeter wave exposure can be adjusted to maximize the differences in magnetic susceptibility among the particles of interest and the other particles of the mixture. Since the magnitude of magnetic susceptibility of a material at its Néel temperature is generally weaker than a ferromagnetic material below its Curie temperature, the method 10 often employs a high gradient magnetic separator.

The method 10 may include other optional steps. For example, the method 10 may include contacting the mixture of particles with an inert or reactive gas. Such contacting may be desirable for many reasons. For example, the method 10 may employ a gas to fluidize the particles, which as described below, helps convey the mixture of particles through process equipment. Alternatively or additionally, the method 10 may use a gas to strip impurities from the solid particles, to form desired reaction products, and the like.

Figure 2:
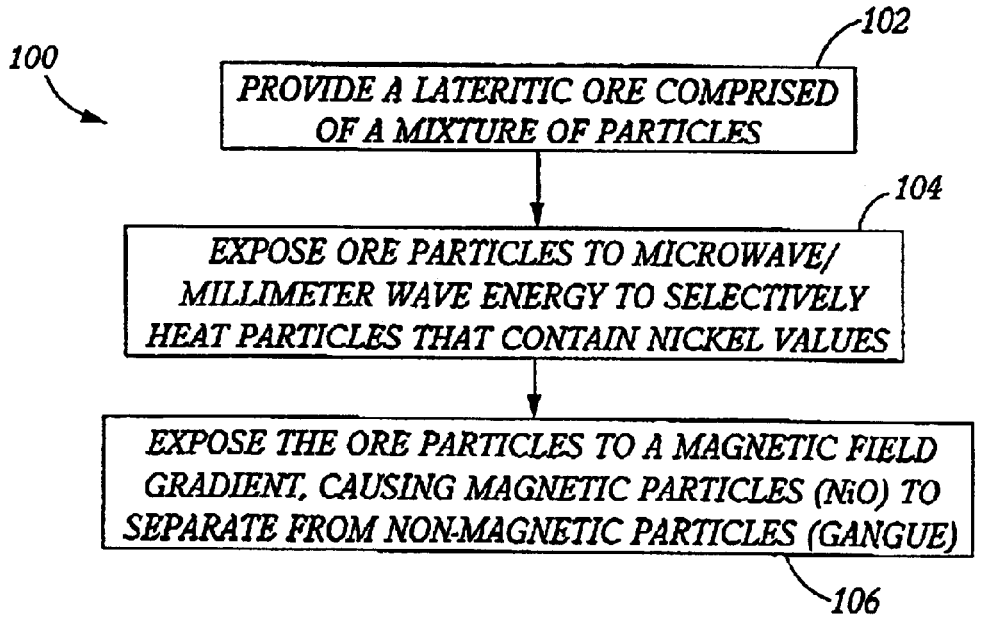
FIG. 2 is a block diagram showing a method of concentrating nickel values of a lateritic ore.

Turning now to an exemplary application, FIG. 2 illustrates a method 100 of concentrating nickel values of a lateritic ore. It should be noted, however, that with suitable modification the method 100 could be used to concentrate many different metal values from a variety of mineral ores. As shown in FIG. 2, the method 100 includes providing 102 a lateritic ore comprised of a mixture of particles. This step may comprise a variety of tasks, including extraction of the lateritic ore from the earth, transportation and storage of the mined ore, and the like. In addition, since effective magnetic separation requires that the component or components of interest comprise discrete particles, the providing step may include liberating the component of interest from the ore matrix—here, nickel oxide—by crushing, grinding (if necessary), and sizing (e.g., screening) the ore particles.

After the particles are crushed and ground to the requisite size, which for a typical lateritic ore is less than about 20 mesh or about 1.3 mm, the ore is exposed 104 to microwave/millimeter wave energy in order to selectively heat particles that contain substantial amounts of nickel values. By selectively heating the nickel oxide particles, the method 100 increases the difference in magnetic susceptibility between particles that contain substantial amounts of nickel values and particles that do not. For nickel oxide, this corresponds to heating the particles to their Néel temperature, which is between about 260° C. and 377° C. It should be understood that the nickel oxide particles could be heated to temperatures different than the Néel temperature (e.g., between 150° C. and 300° C.) so long as they attain the desired level of magnetic susceptibility.

The method 100 also includes exposing 106 the lateritic ore to a magnetic field gradient, which causes at least some of the particles that contain substantial amounts of nickel values to separate from the mixture of particles. Besides nickel values, lateritic ores generally contain other metal values, which will likely have been selectively heated to a temperature different than their Néel temperatures. These particles may retain residual magnetic susceptibility so that during the magnetic separation step, some of them may be entrained by the nickel oxide particles. The resulting concentrated nickel values, and perhaps a small fraction of entrained metal values, may undergo further processing (refining, smelting, etc.) or can be sold as a finished product.

Figure 3:
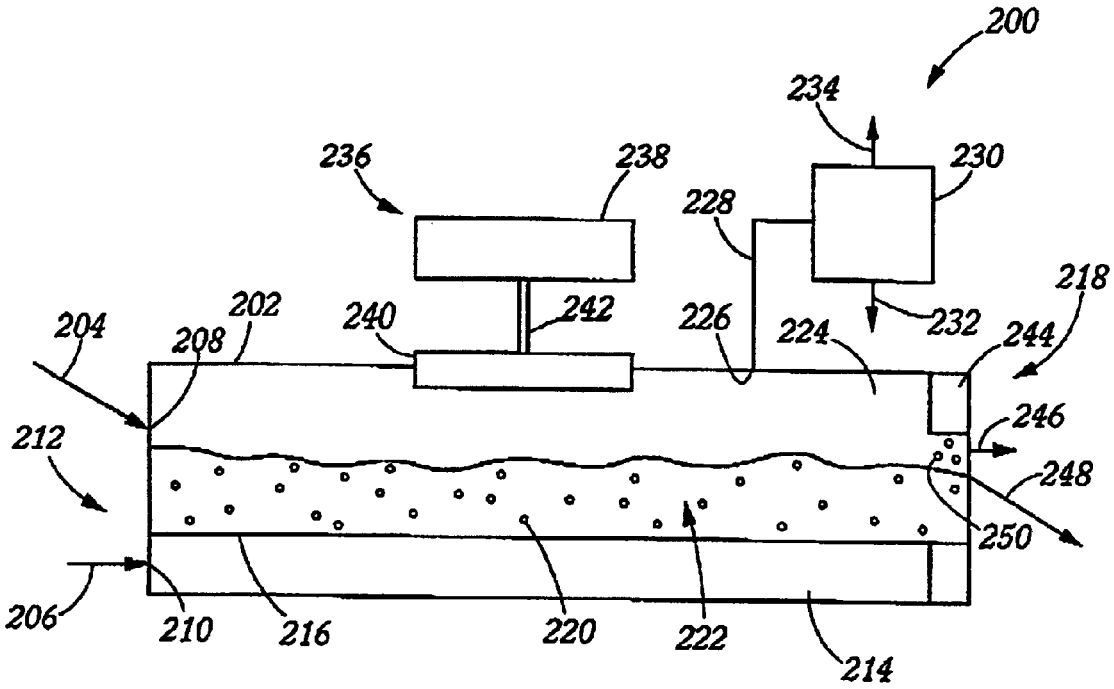
FIG. 3 is schematic view of an apparatus for separating metal values, such as nickel, from a mineral ore, including a lateritic ore.

FIG. 3 shows an apparatus 200 that can be used carryout the processes 10, 100 shown in FIG. 1 and FIG. 2, respectively. The apparatus 200 comprises a vessel 202, which contains the mixture of particles (e.g., crushed and sized ore) during processing. As indicated by arrows 204, 206, the mixture of particles and a gas (typically compressed air, which may be cooled or heated) enter the vessel 202 via ports 208, 210 at a first end 212 of the vessel 202. The gas dumps into a plenum 214 and flows upward through a gas distributor 216 (i.e., grating or perforated plate) that spans the distance between the sides and the first 212 and second 218 ends of the vessel 202.

The solid particles, which are shown schematically as circles 220 in FIG. 3, travel from the first 212 to the second 218 ends of the vessel 202 along the gas distributor 216. To help convey the solid particles 220 between the ends 212, 218 of the vessel 202, the gas flowing upward through the distributor 216 lifts the particles 220, producing a fluidized bed 222 that behaves in a manner similar to a liquid. The gas used to fluidize the particles 220, flows into a disengaging space 224 and exits the vessel 202 via a port 226. A conduit 228 channels the gas into a dust separator 230 (e.g., cyclone) that removes any entrained solids 232 from the gas stream 234. In addition to acting as a fluidizing medium, the gas may strip off impurities, provide a surface coating, react to form a desired product, and so on.

The apparatus 200 includes an energy system 236, which can be used to expose the particles 220 to microwave/millimeter wave energy via a radiative technique. The system 236 includes a source 238 of microwave/millimeter wave energy and an applicator 240, which is disposed within the vessel 202. The system 236 also includes a waveguide 242, which directs the microwave/millimeter wave energy from the source 238 to the applicator 240. As used in this disclosure, microwave/millimeter wave energy refers to energy having frequencies as low as 100 MHz to as high as 3000 GHz. For a discussion of useful systems for generating and applying microwave/millimeter wave energy to process materials, see U.S. Pat. Nos. 4,894,134; 5,784,682; and 6,090,350, which are herein incorporated by reference in their entirety and for all purposes.

As can be seen in FIG. 3, after the particles 220 have been differentially heated through exposure to microwave/millimeter wave energy from the applicator 240, they reach the second end 218 of the vessel 202 where they pass through a magnetic separator 244. As indicated by arrows 246, 248, the magnetic separator diverts magnetic particles 250 (i.e., those having a threshold magnetic susceptibility) away from the non-magnetic particles thereby concentrating the magnetic particles (or non-magnetic particles). As noted above, high gradient magnetic separators are especially useful, but depending on the magnetic susceptibility of the magnetic particles 250, other devices can be used. For a discussion of useful magnetic separators, see Robert H. Perry and Don W. Green, "Perry's Chemical Engineer's Handbook," pp. 19–40 to 19–49 (7th Ed., 1997).

Although the apparatus 200 shown in FIG. 3 utilizes a fluidized bed 222 to convey individual particles 220 between the ends 212, 218 of the vessel 202, other devices can be used. For example, some embodiments may use moving belts, which can be coupled to a magnetic pulley at the second end 218 of the vessel 202 for carrying out the magnetic separation. Other embodiments may rely on gravity to convey particles and may include a gas distribution system for contacting the particles with an inert or reactive gas to strip impurities from the particles, form desired reaction products, modify the surfaces properties of the particles, and the like. The apparatus 200 shown in FIG. 3 is adapted to continuously process mixtures of particles, which minimizes the requisite size of the vessel 202 and hence capital expenditures. However, other apparatuses may be used that operate in a batch or semi-batch mode, which would likely result in higher capital and labor costs, but may result in greater recovery of the material of interest.

Other embodiments may channel the magnetic particles 250 into a second vessel (not shown) where the particles 250 undergo further treatment. Like the apparatus 200 shown in FIG. 3, the second vessel may include the necessary structures for heating the particles 250 (e.g., microwave/millimeter wave source) and for contacting the magnetic particles 250 with an inert or reactive gas (e.g., gas distributor). Such an apparatus could employ a gas that may be the same as or different than any fluidizing gas used, and which includes sulfur (e.g., hydrogen sulfide) in order to convert nickel oxide to nickel sulfide.

It should be understood that the above description is intended to be illustrative and not limiting. Many embodiments will be apparent to those of skill in the art upon reading the above description. Therefore, the scope of the invention should be determined, not with reference to the above description, but instead with reference to the appended claim, along with the full scope of equivalents to which such claim is entitled. The disclosures of all patents, articles and references, including patent applications and publications, if any, are incorporated herein by reference in their entirety and for all purposes.

What is claimed is:

1. A method of separating components of a mixture, the method comprising:

providing a mixture of particles, the mixture comprised of at least a first group of particles and a second group of particles, the first group of particles having a different chemical composition than the second group of particles;

exposing the mixture of particles to millimeter wave energy in order to difference heat the first and second group of particles, thereby increasing the difference in magnetic susceptibility between the first and second group of particles; and exposing the mixture of particles to a magnetic field gradient, the magnetic field gradient causing the particles to separate into first and second fractions, the first fraction having a greater percentage of the first group of particles than the mixture, and the second fraction having a greater percentage of the second group of particles than the mixture, wherein the mixture of particles is a lateritic ore.

2. The method of claim 1, wherein the first group of particles includes one or more metal values.

3. The method of claim 2, wherein exposing the mixture of particles to microwave/millimeter wave energy further comprises heating at least a portion of the first group of particles to approximately the Néel temperature of one of the metal values.

4. The method of claim 2, wherein the first group of particles includes one or more nickel values.

5. The method of claim 1, further comprising a third group of particles that includes one or more cobalt values.

6. The method of claim 1, further comprising contacting the mixture of particles with a gas.

7. A method of concentrating nickel values of a lateritic ore, the method comprising:

providing a lateritic ore comprised of a mixture of particles;

exposing the lateritic ore to microwave/millimeter wave energy in order to selectively heat particles that contain substantial amounts of one or more nickel values, thereby increasing the difference in magnetic susceptibility between the particles that contain substantial amounts of nickel values and particles that contain insubstantial amounts of nickel values;

exposing the lateritic ore to a magnetic field gradient, causing at least some of the particles that contain substantial amounts of nickel values to separate from the mixture of particles.

8. The method of claim 7, wherein the nickel values are nickel oxides.

9. The method of claim 7, wherein exposing the mixture of particles to microwave/millimeter wave energy further comprises heating at least a portion of the particles that contain substantial amounts of nickel values to approximately the Néel temperature of at least one of the nickel values.

10. The method of claim 7, wherein exposing the mixture of particles to microwave/millimeter wave energy further comprises heating at least a portion of the particles that contain substantial amounts of nickel values to a temperature of at least about 150° C.

11. The method of claim 7, wherein exposing the mixture of particles to microwave/millimeter wave energy further comprises heating at least a portion of the particles that contain substantial amounts of nickel values to a temperature of at least about 250° C.

12. The method of claim 7, further comprising contacting the mixture of particles with a gas.

13. The method of claim 7, further comprising fluidizing the mixture of particles.

14. A method of separating components of a mixture, the method comprising:

providing a mixture of particles, the mixture comprised of at least a first group of particles and a second group of particles, the first group of particles having a different chemical composition than the second group of particles;

exposing the mixture of particles to microwave/millimeter wave energy in order to differentially heat the first and second group of particles, thereby increasing the difference in magnetic susceptibility between the first and second group of particles;

exposing the mixture of particles to a magnetic field gradient, the magnetic field gradient causing the particles to separate into first and second fractions, the first fraction having a greater percentage of the first group of particles than the mixture, and the second fraction having a greater percentage of the second group of particles than the mixture wherein the mixture of particles is a lateritic ore.

15. A method of separating components of a mixture, the method comprising:

providing a mixture of particles, the mixture comprised of at least a first group of particles and a second group of particles, the first group of particles having a different chemical composition than the second group of particles;

exposing the mixture of particles to microwave/millimeter wave energy in order to differentially heat the first and second of particles, thereby increasing the difference in magnetic susceptibility between the first and second group of particles;

exposing the mixture of particles to a magnetic field gradient, the magnetic field gradient causing the particles to separate into first and second fractions, the first fraction having a greater percentage of the first group of particles than the mixture, and the second fraction having a greater percentage of the second group of particles than the mixture wherein the first group of particles includes one or more nickel values.

16. A method of separating components of a mixture, the method comprising:

providing a mixture of particles, the mixture comprised of at least a first group of particles and a second group of particles, the first group of particles having a different chemical composition than the second group of particles;

exposing the mixture of particles to microwave/millimeter wave energy in order to differentially heat the first and second group of particles, thereby increasing the difference in magnetic susceptibility between the first and second group of particles;

exposing the mixture of particles to a magnetic field gradient, the magnetic field gradient causing the particles to separate into first and second fractions, the first fraction having a greater percentage of the first group of particles than the mixture, and the second fraction having a greater percentage of the second group of particles than the mixture further comprising a third group of particles that includes one or more cobalt values.

17. A method of separating components of a mixture, the method comprising:

providing a mixture of particles, the mixture comprised of at least a first group of particles and a second group of particles, the first group of particles having a different chemical composition than the second group of particles;

exposing the mixture of particles to microwave/millimeter wave energy in order to differentially heat the first and second group of particles, thereby increasing the difference in magnetic susceptibility between the first and second group of particles;

exposing the mixture of particles to a magnetic field gradient, the magnetic field gradient causing the particles to separate into first and second fractions, the first fraction having a greater percentage of the first group of particles than the mixture, and the second fraction having a greater percentage of the second group of particles than the mixture further comprising fluidizing the mixture of particles.

* * * * *

UNITED STATES PATENT AND TRADEMARK OFFICE

CERTIFICATE OF CORRECTION

PATENT NO. : 6,923,328 B2
DATED : August 2, 2005
INVENTOR(S) : Stephen Birken

It is certified that error appears in the above-identified patent and that said Letters Patent is hereby corrected as shown below:

Column 6,
Line 62, change “difference” to -- differentially --.

Signed and Sealed this

Third Day of January, 2006

JON W. DUDAS
*Director of the United States Patent and Trademark Office*